US007467953B2

(12) United States Patent
Kuo et al.

(10) Patent No.: US 7,467,953 B2
(45) Date of Patent: Dec. 23, 2008

(54) CABLE CONNECTOR ASSEMBLY WITH IMPROVED COUPLER

(75) Inventors: Peter Kuo, Tu-Cheng (TW); Hao Tang, Kunshan (CN)

(73) Assignee: Hon Hai Precision Ind Co. Ltd., Taipei Hsien (TW)

( * ) Notice: Subject to any disclaimer, the term of this patent is extended or adjusted under 35 U.S.C. 154(b) by 0 days.

(21) Appl. No.: 12/009,681

(22) Filed: Jan. 22, 2008

(65) Prior Publication Data

US 2008/0176442 A1 Jul. 24, 2008

(51) Int. Cl.
*H01R 12/00* (2006.01)

(52) U.S. Cl. ..... 439/67; 439/484

(58) Field of Classification Search ..... 439/67, 439/484, 923

See application file for complete search history.

(56) References Cited

U.S. PATENT DOCUMENTS 4,087,146 A * 5/1978 Hudson, Jr. ..... 439/67
4,689,721 A * 8/1987 Damerow et al. ..... 361/707
4,997,377 A * 3/1991 Goto et al. ..... 439/68
5,080,609 A * 1/1992 Fabian et al. ..... 439/541.5
5,154,618 A * 10/1992 Nikoloff et al. ..... 439/67
5,159,751 A * 11/1992 Cottingham et al. ..... 29/832
5,265,322 A * 11/1993 Fisher et al. ..... 29/848
5,692,911 A * 12/1997 Webster et al. ..... 439/67
5,695,347 A * 12/1997 Somerset ..... 439/67
5,947,753 A * 9/1999 Chapman et al. ..... 439/79
5,947,764 A * 9/1999 Pan et al. ..... 439/492
6,176,734 B1 * 1/2001 Juntwait et al. ..... 439/493
6,769,920 B1 * 8/2004 Mease et al. ..... 439/67
6,855,000 B2 * 2/2005 Wu ..... 439/484
6,991,487 B2 1/2006 Wu

FOREIGN PATENT DOCUMENTS

TW 549640 8/2003

* cited by examiner

*Primary Examiner*—Tho D Ta
(74) *Attorney, Agent, or Firm*—Wei Te Chung

(57) ABSTRACT

An electrical connector assembly comprises at least two electrical connectors and a flexible printed circuit; each electrical connector comprises a housing, some contacts each having a curved contacting portion and a flat rear tail portion, and the all flat rear tail portions extends outwardly from the housing to expose out of the housing; wherein the two electrical connectors are assembled on the flexible printed circuit and a certain distance is formed between the two electrical connectors.

13 Claims, 4 Drawing Sheets

CABLE CONNECTOR ASSEMBLY WITH IMPROVED COUPLER

BACKGROUND OF THE INVENTION

1. Field of the Invention

The present invention relates generally to a cable connector assembly, and more particularly to a cable connector assembly used to transmit signals of computers.

2. Description of the Prior Art

Serial ATA is continually improved because of the development of the disk drivers. The U.S. Pat. No. 6,991,487B2 discloses a cable connector assembly. Reference to grates of the patent's FIG. 3, the cable connector assembly comprises a housing 10, some contacts 20 received in the housing 10, a cable set 40 electrically connecting with the contacts 20, an outer cover 50 enclosing the conjunctions of the cable set 40 and the contacts 20, and a fixing portion 60 assembled on the two sides of the conjunctions of the cover 50 and the housing 10. This cable connector assembly has a large width to connect with a mass of electrical devices through many cables. TW Patent No. 549640 discloses another cable connector assembly comprising two housings 4, some contracts 5 received in the housings 4, and a retaining frame 3 connecting with the two housings 4. The retaining frame 3 can provide a connection way due to its configuration. Thus, the electrical connectors 2 can stand firmly on the printed circuit board when it is mated with or unmated from a complementary electrical connector. However, the retaining frame 3 is hard and unflexible, thus, the connectors can not change their positions relative to each other. And the retaining frame 3 is big, thus, the cable connector assembly is large and not to be suitable to the small-size electrical device.

Hence, a cable connector assembly is desired to overcome the above-mentioned shortcomings of the existing antennas.

BRIEF SUMMARY OF THE INVENTION

A primary object, therefore, of the present invention is to provide a cable connector assembly whose connectors are connected by a flexible printed circuit.

In order to implement the above object and overcomes the above-identified deficiencies in the prior art, the electrical connector assembly comprises at least two electrical connectors and a flexible printed circuit; each electrical connector comprises a housing, some contacts each having a curved contacting portion and a flat rear tail portion, and the all flat rear tail portions extends outwardly from the housing to expose out of the housing; wherein the two electrical connectors are assembled on the flexible printed circuit and a certain distance is formed between the two electrical connectors.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
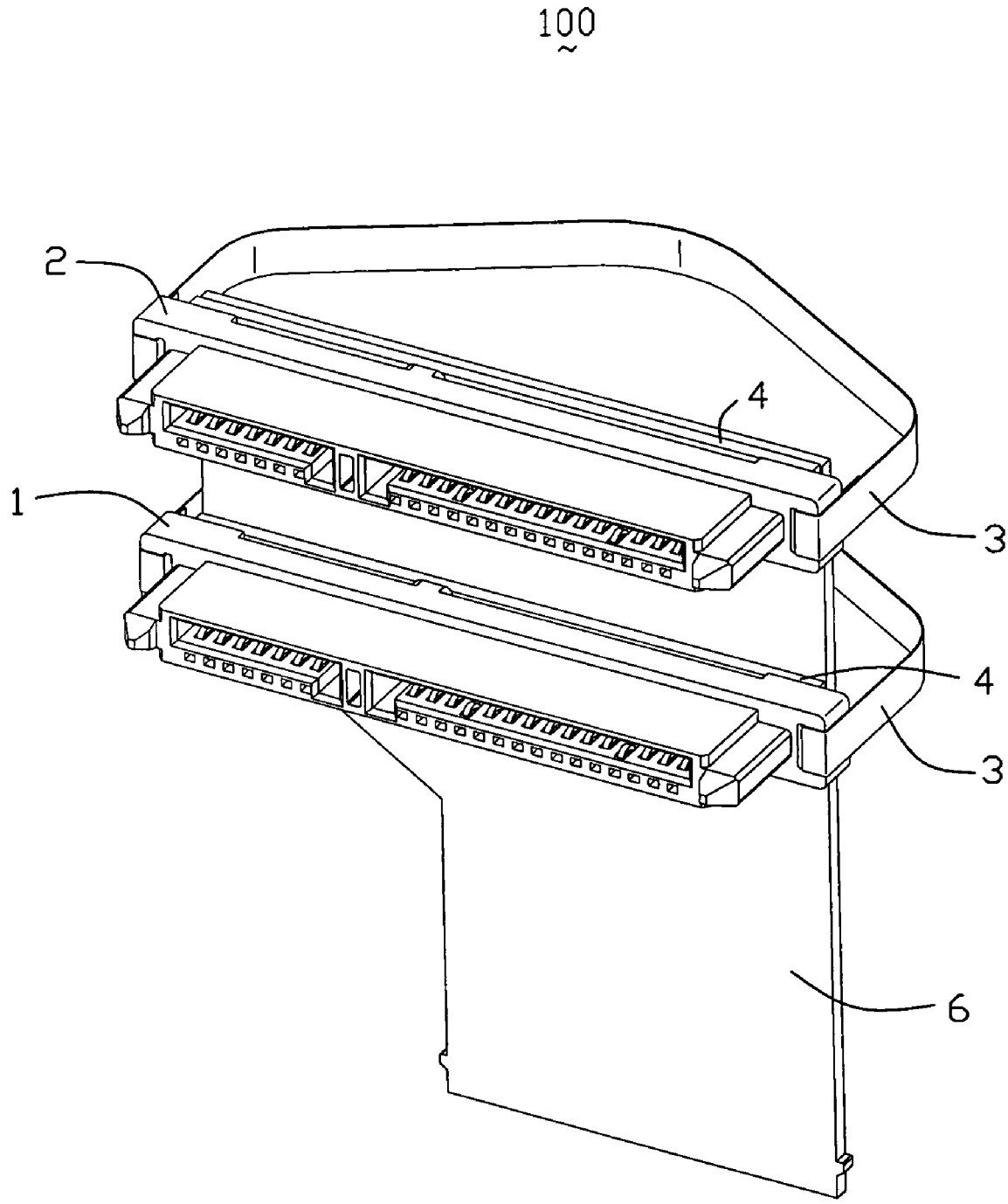
FIG. 1 is a perspective view illustrating the preferred embodiment of the present invention.
Figure 2:
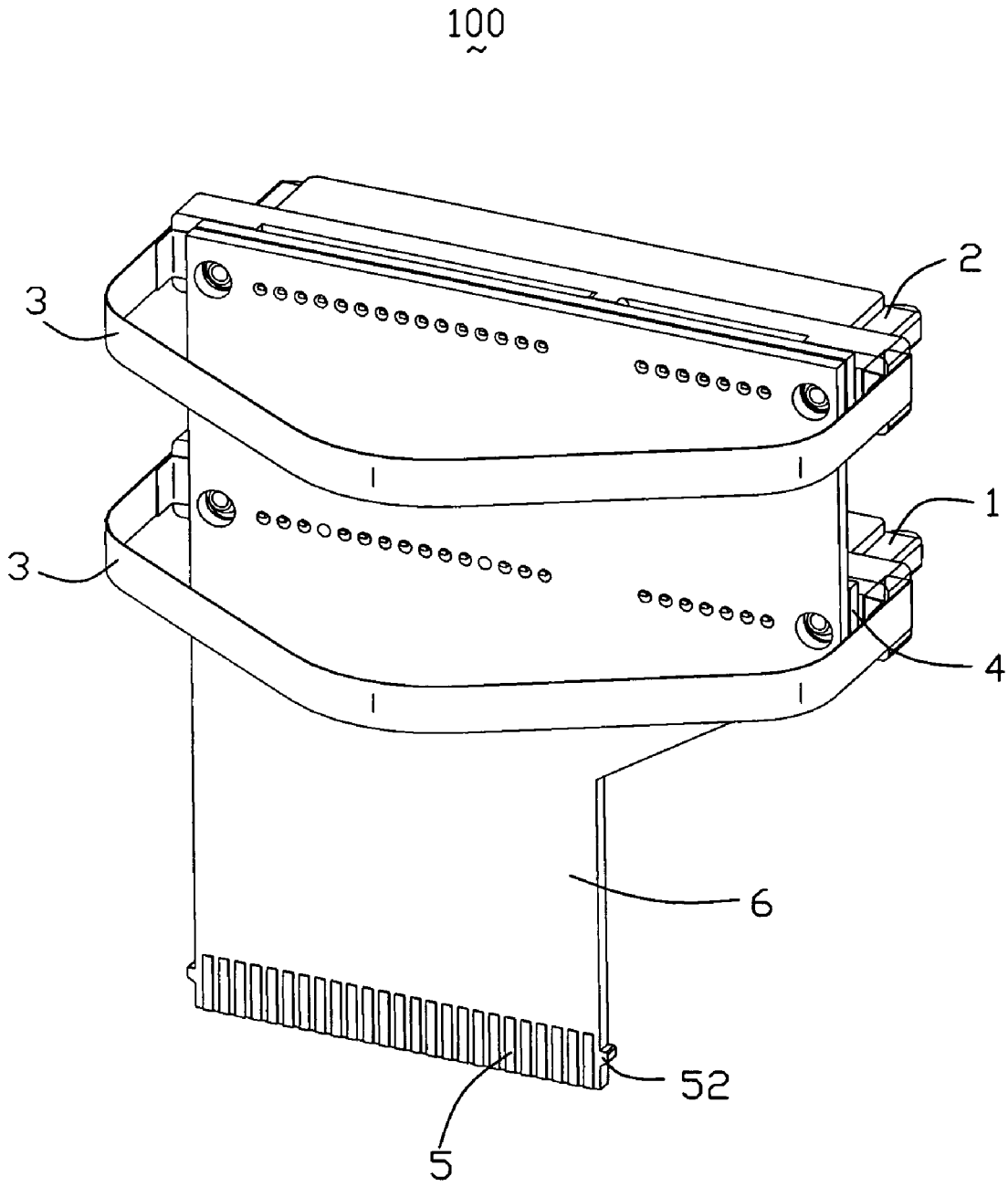
FIG. 2 is a view similar to FIG. 1, but viewed from a different angle.

Reference to FIG. 1 and FIG. 2, perspective views of a cable connector assembly 100 in accordance with a preferred embodiment of the present invention are shown. The cable connector assembly 100 comprises a first electrical connector 1, a second electrical connector 2 stacked with the first electrical connector 1, a pair of pulling strips 3 respectively fixed on the first electrical connector 1 and the second electrical connector 2, a flexible printed circuit (FPC) 6, and a pair of strengthening boards 4 located on the FPC 6 and between the two connectors 1, 2. The first and second electrical connectors 1, 2 all have interfaces in Serial ATA family The first and second electrical connectors 1, 2 are connected to complementary connectors of disk drives, and the one end of the FPC 6 has some golden fingers 5 to connect a complementary connector of a main board. The FPC 6 is on a perpendicular plane, the two electrical connectors 1, 2 stack on one end of the flexible printed circuit along up-to-down direction, and the golden fingers 5 are located on the other end of the flexible printed to connect other connectors.

Figure 3:
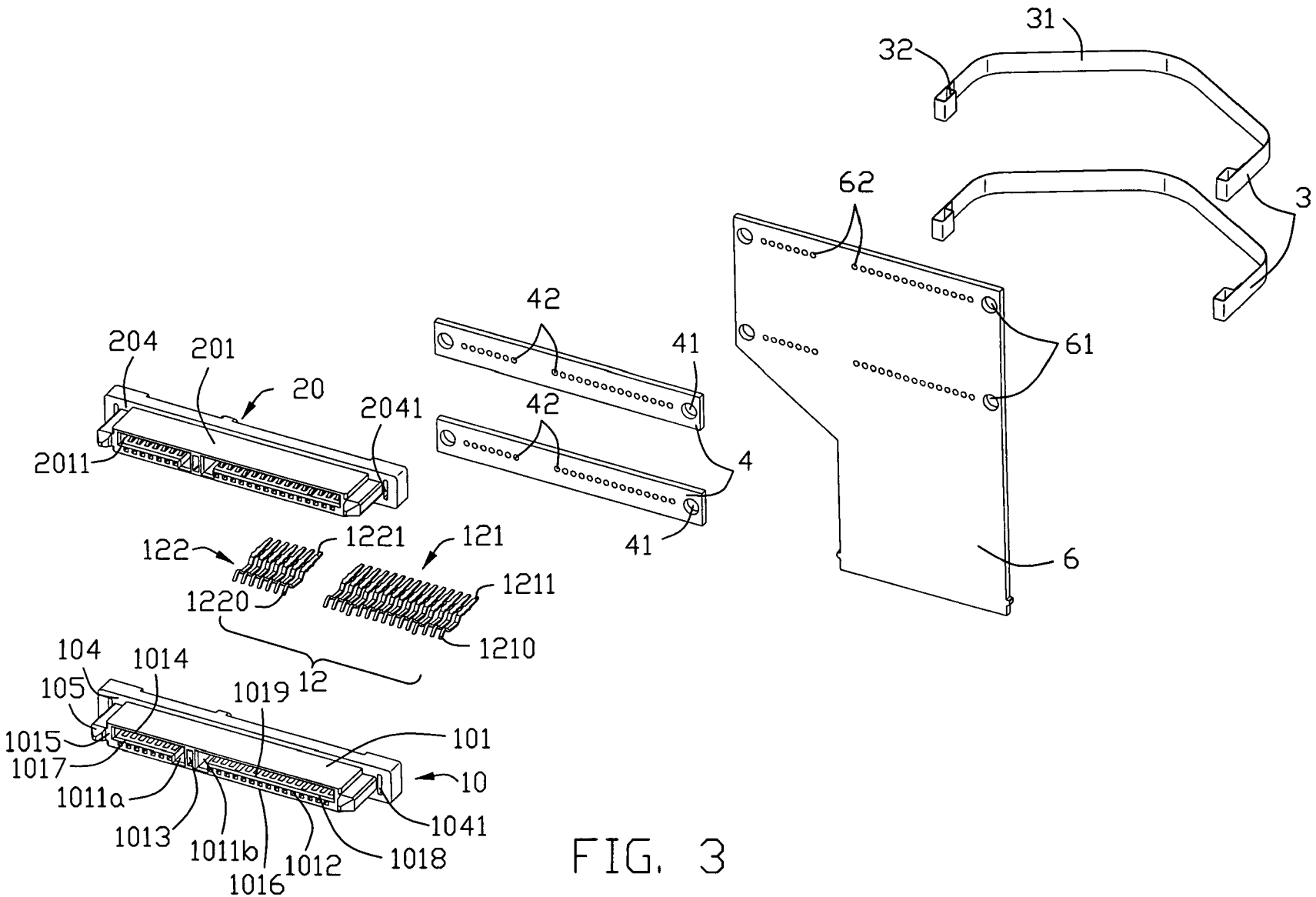
FIG. 3 is an exploded, perspective view of FIG. 1.
Figure 4:
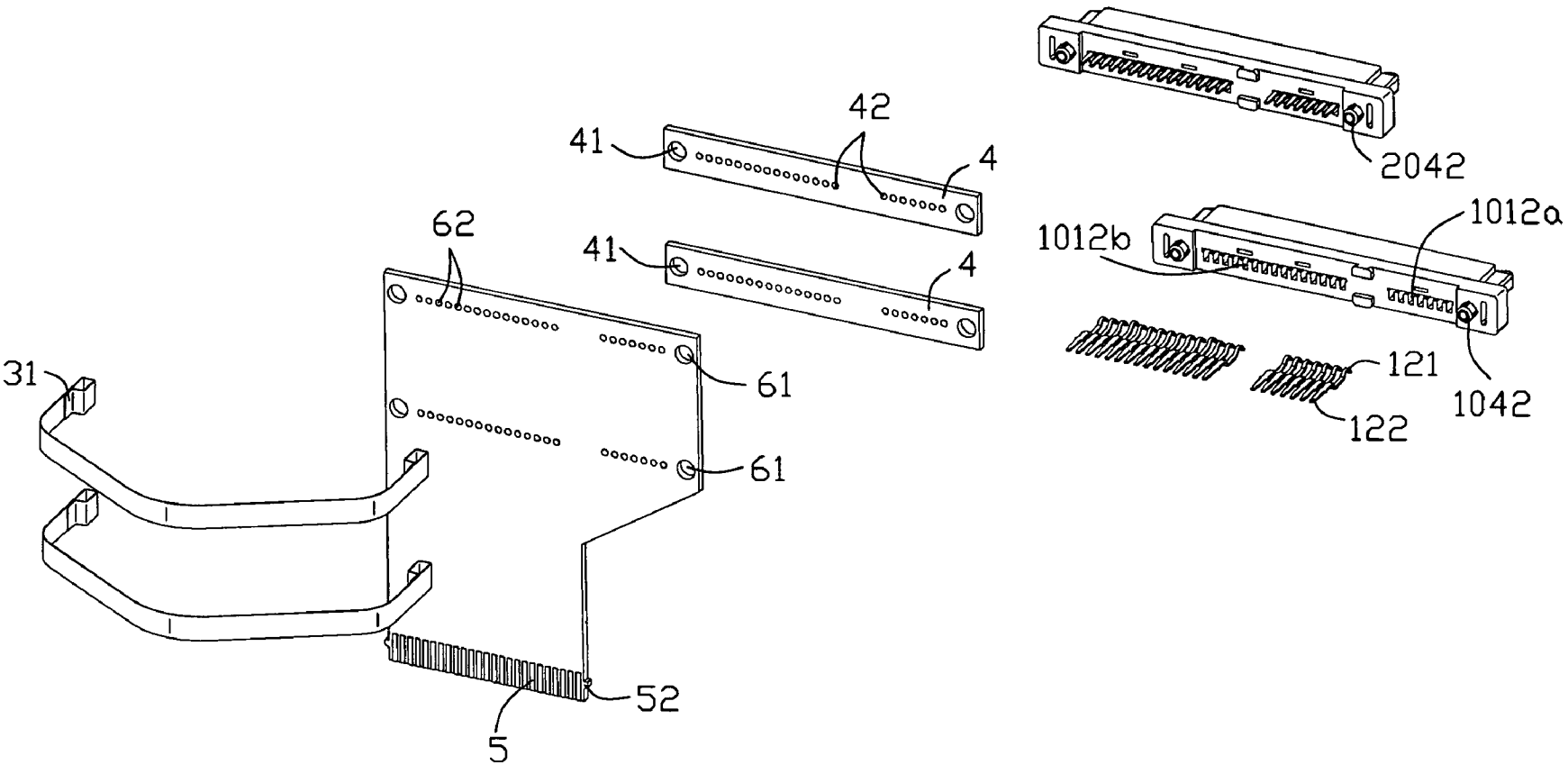
FIG. 4 is a view similar to FIG. 3, but viewed from a different angle.

Reference to FIG. 3 and FIG. 4, the first electrical connector 1 comprises a housing 10 and some contacts 12.

The housing 10 comprises a base portion 104 mainly extending along a lateral direction, and a mating portion 101 extending outward from the base portion 104 with a relative large thickness along the mating direction. The mating portion 101 comprises a relatively upper wall 1014, a relatively lower wall 1016 opposite to the upper wall 1014 and a pair of sidewalls 1015 connecting with the upper and lower walls 1014, 1016. A partition wall 1013 is formed to be parallel to the sidewalls 1015 and connects with the upper and lower walls 1014, 1016. Thus, a first mating segment 1017 and a second mating segment 1018 side by side are formed by the upper and lower walls 1014, 1016. The second mating segment 1018 is longer than the first mating segment 1017 along the lateral direction. Each of the first and second mating segments 1017, 1018 defines L-shape receiving spaces 1011*a*, 1011*b* with the receiving space 1011*b* is larger than the first receiving space 1011*a*. A plurality of first and second passageways 1012*a*, 1012*b* are respectively defined through the lower wall 1016 to communicate with a recess 1019 of the base portion 104 and with the first and second receiving spaces 1011*a*, 1011*b*. The number of the first passageways 1012*a* is fifteen, while the number of the second passageways is seven. A pair of tapered guiding posts 105 is formed with the sidewalls 1015 to guide the insertion of the cable connector assembly 100 with a complementary connector. A pair of grooves 1041 connects the front surface and rear surface of the base portion 101 and respectively on two sides of mating portion 101. A pair of protrusions 1042 extends from the rear surface of the base portion 104 and are between the two grooves 1041. Each groove 1041 has a protrusion 1042 adjacent to itself.

The contacts 12 consist of a set of seven first contacts 121 and a set of fifteen second contacts 122. Each contact 12 comprises a curved contacting portion 1210, 1220, and a flat rear tail portion 1211, 1221. In addition, the seven first contacts 121 are power contacts and the fifteen second contacts 122 are used for signal transmission. The curved contacting portions 1210, 1220 are respectively fixed in the first and second passageways 1012*a*, 1012*b*. And the flat rear tail portions 1211, 1221 extend rearward from the curved contacting portions 1210, 1220 through the passageways 1012*a*, 1012*b* to expose out the housing 10.

The second electrical connector 2 has similar structure to the first electrical connector 1.

The two pulling strips 3 respectively extend through the first and second electrical connectors 1, 2, thus, each pulling strip 3 has its corresponding electrical connector. Wherein each pulling strip 3 comprises a handing portion 31 facing to the rear surface of the corresponding electrical connector and two free ends 32 respectively extends through the two grooves 1041 from the front surface to the rear surface of the respectively corresponding electrical connector. Each electrical connector 1, 2 can be apart from the complementary connector through pulling the handing portion 31 of the pulling strip 3.

FPC 6 connects the first electrical connector 1 and the second electrical connector 2. FPC 6 comprises two pair of apertures 61 respectively corresponding to the two pairs of protrusions 1042, 2042 of the electrical connectors 1, 2 and two troops of mini holes 62 respectively between each pair of apertures 61. The apertures 61 are used to fix the electrical connectors 1, 2 on the FPC 6. Each flat rear tail portion 1211, 1221 is respectively through its corresponding hole 62. The end of FPC 6 opposite to the electrical connectors 1, 2 has some golden fingers 5. A pair of blocking portions 52 are respectively defined on two sides of the fingers 5 and on the two side surfaces of FPC 6. FPC 6 has some transmitting lines (not shown) to connect the contacts 12 of the first and second electrical connectors 1, 2 and the golden fingers 5. One transmitting line electrically connects one golden finger 5 to one flat rear tail portion 1211, 1221 of the first and second electrical connectors 1, 2. So the first, second electrical connectors 1, 2 and the golden fingers 5 electrically connect to each other.

The pair of strengthening boards 4 are made of insulative material and are respectively defined between the FPC 6 and the two base portions 104 of the electrical connectors 1, 2. Each strengthening board 4 comprises a pair of apertures 41 to provide passageways for the protrusions 1042 or 2042 of the electrical connectors 1, 2, and a troop of mini holes 42 to provide passageways for the flat rear tail portions 1211 or 1221.

In assembly, the first electrical connector 1 connects the strengthening board 4 and the FPC 6 with the pair of protrusions 1041 overlapping the apertures 41, 61 and all the flat rear tail portions 1211, 1221 going through the troop of holes 42, 62. Thus, the strengthening board 4 is between the first electrical connector 1 and the FPC 6. And the ends of the flat rear tail portions 1211, 1221 are respectively soldered on the FPC 6. The pulling strip 3 connects one of the pair of grooves 1041 to the other one of the pair of the grooves 1041 and enclose the FPC 6. And the ends 32 of the pulling strip 31 respectively go through the grooves 1014 to be fixed on the pulling strip 31. The second electrical connector 2 is assembled on the FPC 6 with the strengthening board 4 by the same means which the first electrical connector 1 uses. The first electrical connector 1 is apart from the second electrical connector 2. Thus, when the first and second electrical connectors 1, 2 are assembled on the complementary connectors, the distance between the first and second electrical connectors 1, 2 can be regulated for the FPC 6 being able to be flexed. On the other hand, the upper pulling strip 3 and the lower pulling strip 3 may be integrated as one piece at some respective proper positions, if necessary, for easy disassembling.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. An electrical connector assembly, comprises:

at least two electrical connectors, each electrical connector comprising a housing, some contacts each having a curved contacting portion and a flat rear tail portion, and the all flat rear tail portions extending outwardly from the housing to expose out of the housing; and a flexible printed circuit;

at least two pulling strips corresponding to the electrical connectors;

wherein said each of pulling strips has two ends to fix on two sides of one electrical connector and encloses the flexible printed circuit;

wherein the two electrical connectors are assembled on the flexible printed circuit and a certain distance is formed between the two electrical connectors;

wherein each of electrical connectors has a strengthen board made of insulative material and between the flexible printed circuit and the electrical connector;

wherein said flexible printed circuit and the strengthen board comprise some apertures and holes to fix the electrical connectors;

wherein said contacts of the electrical connectors respectively extend through the holes of the strengthen board and the flexible printed circuit.

2. The electrical connector assembly as claimed in claim 1, wherein said electrical connectors all have interfaces in Serial ATA family.

3. The electrical connector assembly as claimed in claim 1, wherein said two electrical connectors have same structures.

4. The electrical connector assembly as claimed in claim 1, wherein said flexible printed circuit is on a perpendicular plane, the two electrical connectors stack on one end of the flexible printed circuit along up-to-down direction, and the other end of the flexible printed connects other connectors.

5. The electrical connector assembly as claimed in claim 1, wherein said each of electrical connectors comprises a pair of protrusions on the two sides of the mating portion and extends through the apertures on the strengthen board and the flexible printed circuit.

6. The electrical connector assembly as claimed in claim 1, wherein said electrical connectors are arranged on one end of the flexible printed circuit and connect other connectors through the flexible printed circuit.

7. The electrical connector assembly as claimed in claim 6, wherein each electrical connector comprises a base portion and a mating portion, a partition wall is formed to be perpendicular to the mating portion to divide the mating portion to a first mating segment and a second mating segment side by side.

8. The electrical connector assembly as claimed in claim 7, wherein each of the first and second mating segments defines an L-shape receiving space and said two receiving spaces have different lengths.

9. The electrical connector assembly as claimed in claim 6, wherein said flexible printed circuit comprises some golden fingers and some electric lines respectively connecting the golden fingers to connect the electrical connectors.

10. The electrical connector assembly as claimed in claim 9, wherein the number of said first contacts is seven and the number of said second contacts is fifteen.

11. The electrical connector assembly as claimed in claim 8, wherein said each of contacts of the electrical connectors comprises a first contact for signal transmission and a second contacts to form power contacts.

12. The electrical connector assembly as claimed in claim 11, wherein said one contact of the first electrical connector corresponds one contact of the second electrical connector, and each pair of contacts electrical connect to each other.

13. An electrical connector assembly comprising:

a flexible printed circuit (FPC) defining opposite mounting face and pulling face;

a connection port formed on one end of said FPC;

the mounting face defined on the FPC away from said connection port;

a first electrical connector mounted on a first position of said mounting face;

a second electrical connector mounted on a second position of said mounting face which is spaced from the first position;

a first pulling strip linked to the first electrical connector and exposed upon the pulling face; a second pulling strip linked to the second electrical connector and exposed upon the pulling face;

wherein each of the first pulling strip and the second pulling strip is connected to two opposite longitudinal ends of the corresponding connector;

wherein said first pulling strip and said second pulling strip are spaced and independent from each other so as to assure independent operation thereof.

* * * * *